United States Patent [19]

Lehman

[11] 4,055,193

[45] Oct. 25, 1977

[54] CIGARETTE SNUFFING ATTACHMENT FOR AN ASHTRAY

[75] Inventor: James Arlo Lehman, El Cajon, Calif.

[73] Assignee: Warner-Lehman Corporation, El Cajon, Calif.

[21] Appl. No.: 741,803

[22] Filed: Nov. 15, 1976

Related U.S. Application Data

[63] Continuation-in-part of Ser. No. 722,708, Sept. 13, 1976, abandoned.

[51] Int. Cl.[2] ..... A24F 13/18; A24F 19/14

[52] U.S. Cl. ..... 131/235 R; 131/241; 131/256

[58] Field of Search ..... 131/235 R, 241, 236, 131/256, 231; 248/226.4

[56] References Cited

U.S. PATENT DOCUMENTS

| | | | |
|---|---|---|---|
| 2,661,747 | 12/1953 | Manion | 131/241 X |
| 2,748,778 | 6/1956 | Olson | 131/235 R |
| 3,111,128 | 11/1963 | Yard, Jr. | 131/256 |
| 3,477,444 | 11/1969 | Adams et al. | 131/235 R |
| 3,486,509 | 12/1969 | Menold | 131/235 R |
| 3,500,835 | 3/1970 | Klassen | 131/235 R |

*Primary Examiner*—Stephen C. Pellegrino
*Attorney, Agent, or Firm*—Frank D. Gilliam

[57] ABSTRACT

A cigarette snuffing attachment for an ashtray comprises a snuffing tube to receive and extinguish a cigarette, having a lever-operated removable bottom to permit the dropping of the cigarette but through the tube and into the ashtray, there being specialized means of attaching the snuffing device to the conventional snuffing eyelet provided in most, if not all, vehicle ashtrays, and a slightly modified attachment means fits household ashtrays, the attaching means including a clamp having two gripping elements, one of which is screw controlled, the clamp being selectively attachable to the snuffing device such that the latter is adjustable both angularly and vertically relative to the ashtray.

6 Claims, 11 Drawing Figures

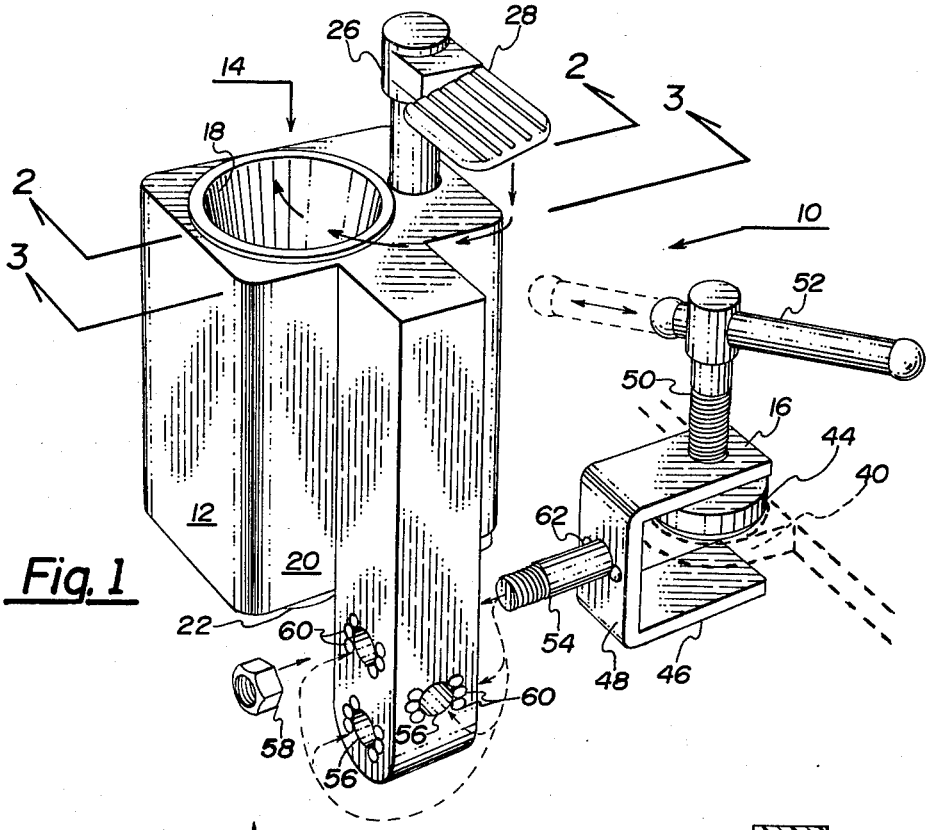
Fig. 1
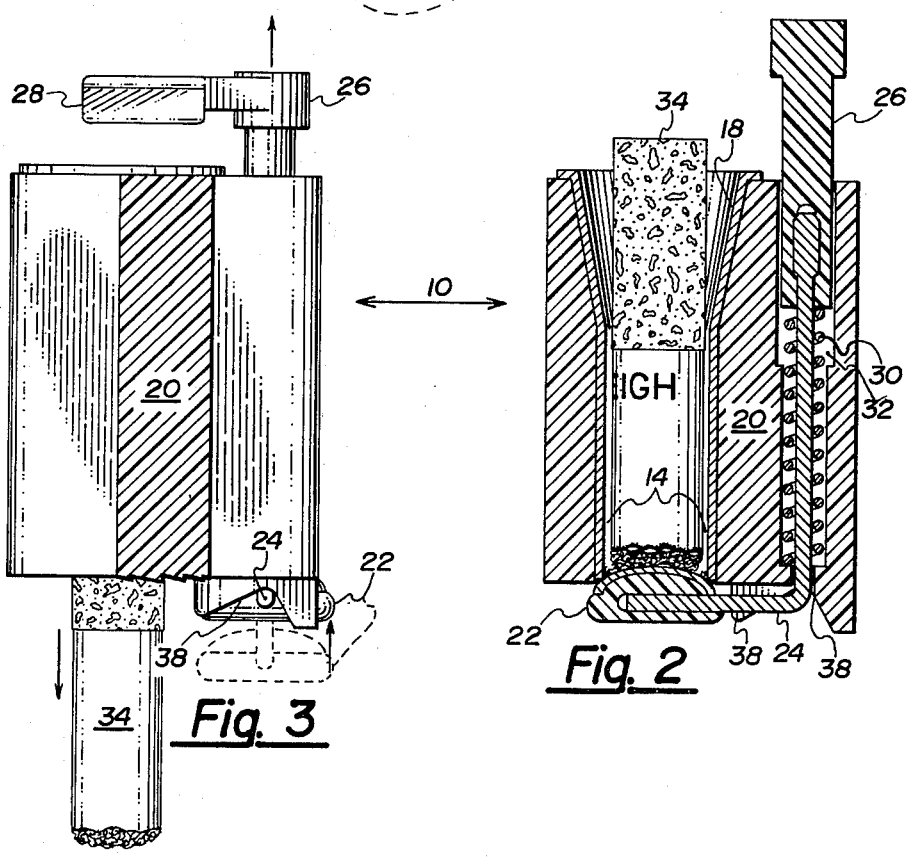
Fig. 3
Fig. 2

CIGARETTE SNUFFING ATTACHMENT FOR AN ASHTRAY

BACKGROUND OF THE INVENTION

The invention is a continuation-in-part of an application, Ser. No. 722,708, filed Sept. 13, 1976, now abandoned, on a CIGARETTE SNUFFING ATTACHMENT FOR A VEHICLE ASHTRAY.

That application related to cigarette snuffing devices and particularly to an adaptation of a snuffing device disclosed in U.S. Pat. No. 3,749,104, issued to PETER WANSA on July 31, 1973. The device of that patent is a useful cigarette snuffer for carrying in a pocket or purse but does not include means for attaching the snuffer to an ashtray in a vehicle or otherwise. The present application provides an attachment applicable to a household ashtray as an alternative to the auto ashtray mount of the parent application.

SUMMARY OF THE INVENTION

The present invention is an adaptation of the snuffer disclosed in the above-referenced patent which includes an adjustable mounting means such that the snuffer can be easily attached to any, or almost any, automobile or household ashtray by means of a unique clamp and other connecting structure to permit clamping the unit directly onto the snuffing eyelet, which is universally provided in conventional ashtrays in automobiles or the lip of a household ashtray.

The clamp and related structure permit the snuffing device to be mounted at one of several angles relative to the ashtray and the unit can be positioned at one of selected heights and ninety-degree orientations about the vertical relative to the ashtray, so that the device is universally applicable and may be arranged at a particular angle to please the user. This versatility is of particular advantage in the automotive application where the fixed nature of the existing ashtray as well as the driver make versatility in angle selection important.

BRIEF DESCRIPTION OF THE DRAWINGS

FIG. 1 is a perspective view of the snuffing attachment showing the mounting clamp removed;

FIG. 2 is a vertical section of the snuffing device taken along lines 2—2 of FIG. 1;

FIG. 3 is a vertical section of the snuffing device taken along lines 3—3 of FIG. 1;

DETAILED DESCRIPTION OF THE PREFERRED EMBODIMENTS

Figure 4:
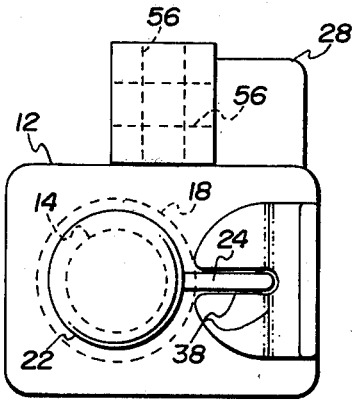
FIG. 4 is a bottom view of the snuffing device without the mounting clamp, showing the bottom cap and arm connecting it.
Figure 5:
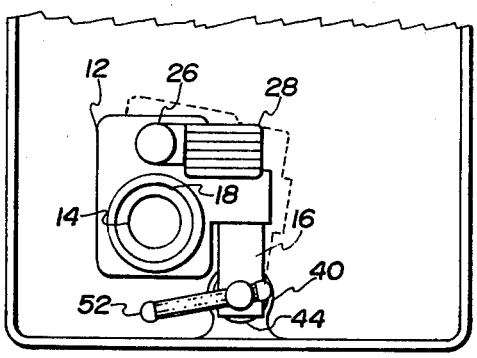
FIG. 5 is a top elevation view showing the device attached to an ashtray.

The snuffing attachment is indicated by the numeral 10, which includes the snuffing device 12 which has a bore or tube 14 therein as is better illustrated in FIG. 2, the attachment further including the clamp 16 together with the attaching structure connecting the clamp and the snuffing device. The snuffing device itself can be best understood by referring to FIGS. 2 and 4, FIG. 2 showing the snuffing tube 14 which is made of metal or other material not affected by heat and preferably heat conductive. The snuffing tube is flared as at 18 near the top for obvious reasons and it is embedded in a casing 20. The bottom of the snuffing tube is covered by a cap 22 operated by an arm 24 connected by shaft 26 to a finger-operated lever 28, the shaft together with a compressed spring 30 being disposed inside a bore 32 in the casing so that the cap is biased against the bottom of the tube.

As can be seen in FIG. 2, the snuffing tube is slightly larger than the size of an ordinary cigarette 34 so that when a butt is inserted as shown, it will soon be extinguished due to the absence of air. The butt may be released by the pressing lever which removes the cap 22 so that the butt falls in the ashtray 36 to which the device is attached.

It will be noted that as shown in FIG. 4, a portion of the casing 20 at the bottom of the bore 32 is extended to define selective seating areas 38 for the arm 24 so that the arm will be guided such that the cap will fit over the bottom of the bore or will be disposed clear of the bore by ninety degrees. One of the features of the snuffing device is the lever arm 28 which is angularly displaced ninety degrees relative to the cap 22 so that when the cap is removed from the snuffing tube the lever covers the top so that it is impossible to insert a cigarette butt into the snuffing tube.

Turning now to the means of attaching the snuffing device to the ashtray, it will be noted that all or nearly all of the ashtrays currently used in automobiles have a snuffing eyelet 40, and that the eyelets may vary somewhat but are essentially the same, having a concave top surface to receive the hot ash of a cigarette butt. The present invention includes a clamp 16 which has two gripping elements 44 and 46 to engage the eyelet. The bottom element 46 is part of a C-shaped bracket 48 which mounts a threaded post 50 having a sliding T-bar in the upper end so that the upper element may be brought into contact with the top surface of the eyelet and the clamp will be firmly attached thereto. Element 44 differs from Element 46 in that it has a convex surface with a radius of curvature greater than the largest anticipated to be found in the top surface of a snuffing eyelet so that the attachment on the rim of the eyelet and the clamp will not wobble.

The attachment means for attaching the clamp to the snuffing device includes the capability of adjusting these two members relative to one another both angularly about their connecting axis and about the vertical axis, and a vertical height adjustment may also be made. The structure to accomplish this includes a threaded shaft or bolt 54 which may be passed through one of three bores 56 and secured thereon with a nut 58. Thus, by selecting which of the bores is used, the user is availed of two possible vertical positions of the snuffing device and one ninety-degree variation about the vertical axis for installation. It will also be noted that a certain amount of flexibility in the exact orientation of the unit about the vertical axis is inherent in the clamp 16, as, depending upon the particular type of eyelet and its attachment to the ashtray, it can be adjusted somewhat in its orientation about the vertical axis.

Figure 6:
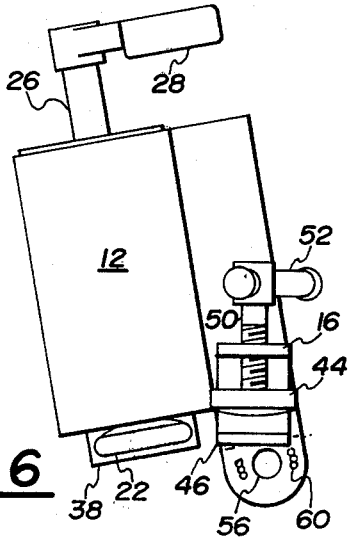
FIG. 6 is a side elevation view showing one possible orientation of the device relative to the snuffing eyelet.
Figure 7:
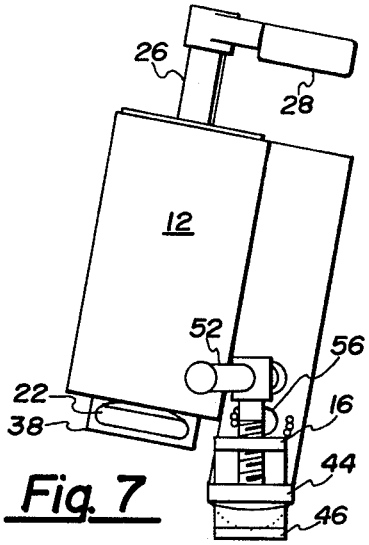
FIG. 7 is a view similar to FIG. 6 showing yet another possible orientation of the device.
Figure 8:
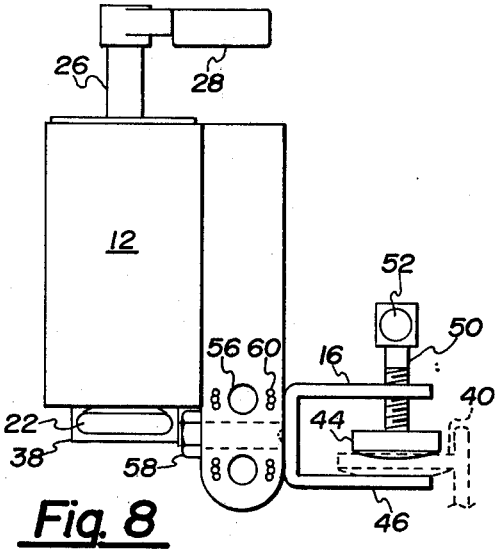
FIG. 8 is a side elevation view showing the mounting attachment mounted to the snuffing eyelet of an ashtray.
Figure 9:
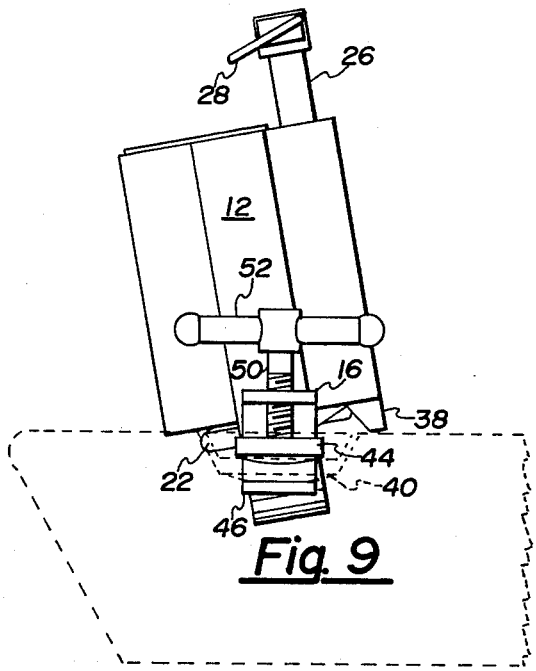
FIG. 9 is a front elevational view showing another possible orientation of the device.

Surrounding each of the bores 56, and on both ends of the bore, are a number of hollows 60 arranged in a star pattern, and on either side of the bolt 54 the bracket 48 is provided with nipples or detents 62 which cooperate with the "stars" to enable the snuffing device to be angularly varied such that the axis of the snuffing tube deviates from the vertical as shown in FIGS. 6 and 7.

Figure 10:
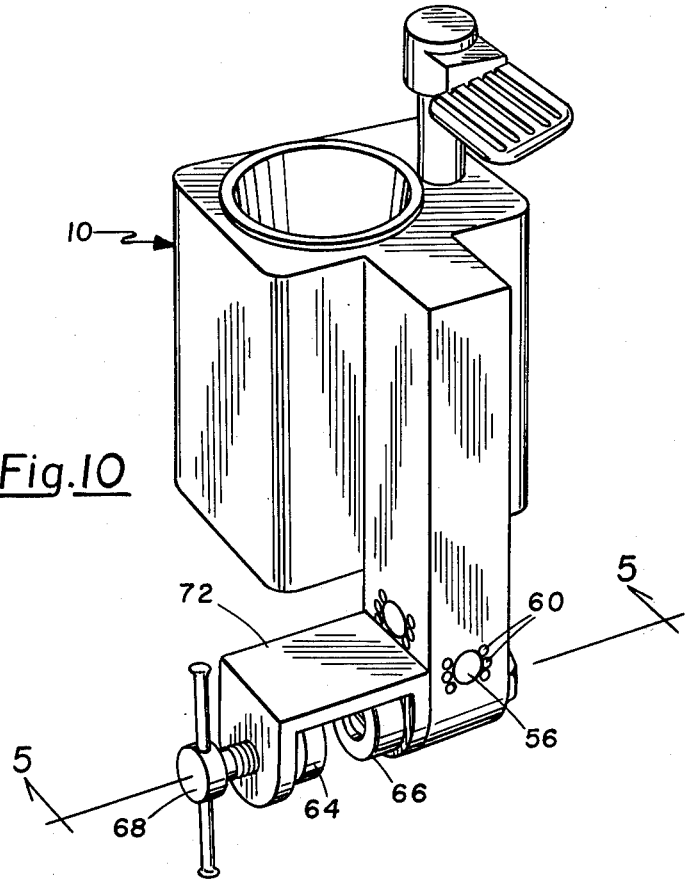
FIG. 10 is a perspective view of the unit with a slightly modified clamp adopted for use on a household ashtray.
Figure 11:
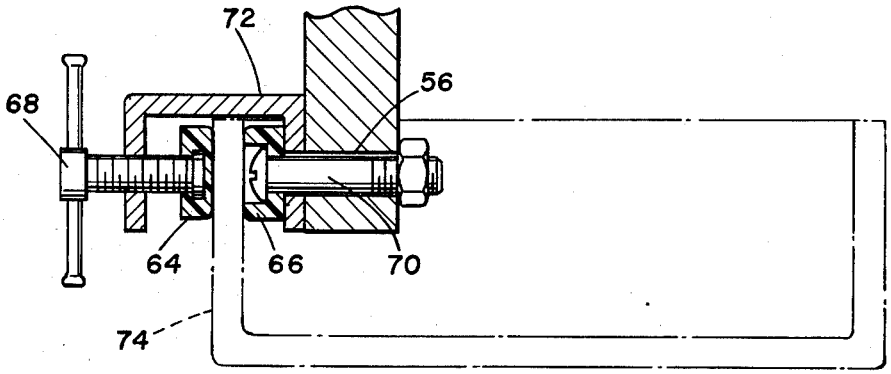
FIG. 11 is a view of the unit of FIG. 10 showing the clamp attached to an actual ashtray.

An embodiment of the invention is shown in FIGS. 10 and 11 which is modified slightly to adapt the unit for installation on the household ashtray as opposed to an automobile ashtray. Rather than having the vertically compressed gripping elements, a pair of resilient pads 64 and 66 are mounted on the ends of T-bar tightener 68 and bolt 70. The T-bar and bolt pass through parallel ends of C-shaped bracket 72, which is connected to the snuffing device by means of the bolt 70 in a fashion similar to the above-described embodiment. Thus, it can be seen that the resilient pads 64 and 66 are made to compress along a horizontal axis thereby gripping the vertical sidewalls 74 of a conventional household ashtray.

Clearly, not all ashtrays have the simple sidewall structure illustrated in FIG. 11, although even the more ornate versions would ordinarily have some kind of peripheral lip to which the clamp may be attached. To provide the entire assembly with versatility, the household embodiment could be provided with perhaps two sizes of C-brackets 72 in case thick-edged ashtrays are used. Also, it would of course be possible, depending upon the economics of the situation, to provide as an alternative, the eyelet gripping clamp of FIGS. 1 through 9 in the same package with the clamp of FIGS. 10 and 11.

It is thus possible to install the snuffing attachment described herein to any known vehicular or household ashtray, and the installation can be at any angle and position which is convenient to the user. Use of the unit will avoid smoldering fires which on occasion ignite ashtrays and in the case of moving vehicles are particularly difficult to extinguish short of emptying the ashtrays on the street. This practice may be the only way to extinguish the fire but is not only messy but dangerous as a trail of hot sparks and cigarette butts emanates from the window. Thus, the invention as described and claimed is in addition to being reasonably economical to manufacture, provides the amenities of convenience, cleanliness, and even safety to those who use it.

I claim:

1. A cigarette snuffing attachment for an automobile ashtray having a snuffing eyelet, said attachment comprising:

a. snuffing device having means to extinguish a lighted cigarette;

b. a clamp for clamping an ashtray; and c. means connecting said clamp to said snuffing device, whereby said snuffing device is attached to an ashtray to insure the complete and safe snuffing of cigarette butts placed therein, said connecting means is angularly adjustable to permit installation of said snuffing device at a selected orientation relative to an ashtray to which said device is attached;

d. said clamp and said snuffing device are connected by a shaft and are rotatable relative to one another on said shaft, and said connecting means includes detents to permit the selection of one of several angular orientations of the snuffing device relative to the clamp about said shaft.

2. Structure according to claim 1 wherein said clamp means is for use on the snuffing eyelet of an automotive ashtray and includes a pair of opposed eyelet gripping elements, one of which has a convex radius of curvature at least as large as the radius of curvature of the concave surface of the largest eyelet to which the snuffing attachment is to be attached, whereby said convex gripping element will seat securely against tye eyelet rim.

3. Structure according to claim 2 wherein one of said gripping elements is mounted on the end of a threaded post threadedly engaging a portion of said clamp and operable by a sliding T-bar to compress one of said gripping elements against the other.

4. Structure according to claim 1 wherein said means connecting said snuffing device and said clamp is vertically adjustable to permit the mounting of said snuffing attachment at selected different levels relative to an ashtray to which it is attached.

5. Structure according to claim 4 wherein said attachment means includes a plurality of bores through said snuffing device and a bolt extending from said clamp to be selectively engaged in one of said bores.

6. Structure according to claim 1 wherein said clamp includes a pair of opposed resilient gripping elements and means for compressing one of said gripping elements against the other along a substantially horizontal axis to grip a substantially vertical sidewall of a household ashtray.

* * * * *